US006000233A

United States Patent [19]

Nishida et al.

[11] Patent Number: 6,000,233

[45] Date of Patent: Dec. 14, 1999

[54] REFRIGERANT CYCLE

[75] Inventors: Shin Nishida, Anjo; Hisayoshi Sakakibara, Nishio; Yasutaka Kuroda, Anjo, all of Japan

[73] Assignee: Denso Corporation, Kariya, Japan

[21] Appl. No.: 09/150,318

[22] Filed: Sep. 9, 1998

[30] Foreign Application Priority Data

Sep. 25, 1997 [JP] Japan ..... 9-260631

[51] Int. Cl.[6] ..... F25B 41/00

[52] U.S. Cl. ..... 62/114; 62/470

[58] Field of Search ..... 62/470, 471, 472, 62/114

[56] References Cited

U.S. PATENT DOCUMENTS 4,187,695 2/1980 Schumaker ..... 62/503

5,689,880 11/1997 Petty ..... 29/890.06

5,799,503 9/1998 Koda et al. ..... 62/503

*Primary Examiner*—Henry Bennett

*Assistant Examiner*—Malik N. Drake

*Attorney, Agent, or Firm*—Harness, Dickey & Pierce, PLC

[57] ABSTRACT

In a $CO_2$ refrigerant cycle, a lubricating oil for a compressor has a compatibility relative to $CO_2$ refrigerant, and the compatibility of the lubricating oil relative to the $CO_2$ refrigerant at a pressure lower than a critical pressure of the $CO_2$ refrigerant is lower than that at a pressure higher than the critical pressure of the $CO_2$ refrigerant. Thus, in a low-pressure side such as an accumulator of the $CO_2$ refrigerant cycle, because a liquid lubricating oil is separated with a liquid $CO_2$ refrigerant, only the lubricating oil can be readily introduced into a suction side of the compressor, and it can prevent the liquid $CO_2$ refrigerant from being sucked into the compressor. As a result, it can prevent a damage to the compressor while preventing deterioration of coefficient of performance of the $CO_2$ refrigerant cycle.

12 Claims, 4 Drawing Sheets

REFRIGERANT CYCLE

CROSS-REFERENCE TO RELATED APPLICATION

This application is related to and claims priority from Japanese Patent Application No. Hei. 9-260631 filed on Sep. 25, 1997, the contents of which are hereby incorporated by reference.

BACKGROUND OF THE INVENTION

1. Field of the Invention

The present invention relates to a refrigerant cycle using carbon dioxide as refrigerant, in which a pressure within a radiator exceeds a critical pressure of carbon dioxide.

2. Description of Related Art

JP-B2-7-18602 discloses a refrigerant cycle using carbon dioxide (hereinafter referred to as "$CO_2$ refrigerant cycle") as refrigerant. In the conventional $CO_2$ refrigerant cycle, the operation is similar to that of a general refrigerant cycle using flon as refrigerant. That is, as shown by A-B-C-D-A in Mollier chard of FIG. 5, gas $CO_2$ refrigerant is compressed in a compressor (A-B), and high-temperature high-pressure $CO_2$ refrigerant in a super-critical state is cooled in a radiator (B-C). The $CO_2$ refrigerant from the radiator is decompressed in a press-reducing unit (C-D), and is vaporized in an evaporator (D-A). In this case, because $CO_2$ refrigerant becomes in gas-liquid two-phase when the pressure of $CO_2$ refrigerant is equal to or less than the saturated liquid pressure of the $CO_2$ refrigerant, the $CO_2$ refrigerant is changed from the super-critical state to a gas-liquid two-phase state through a liquid state when $CO_2$ refrigerant is slowly changed from C state to D state in FIG. 5.

In the super-critical state, $CO_2$ molecules move similarly to the gas state, while density of $CO_2$ refrigerant is approximately equal to that of liquid $CO_2$. However, the critical temperature of $CO_2$ refrigerant is approximately 31° C. which is lower than the critical temperature (e.g., 112° C. in R12) of flon. Therefore, in the conventional $CO_2$ refrigerant cycle, the $CO_2$ refrigerant is not condensed at an outlet (C point) of the radiator in the summer. Further, the state of the $CO_2$ refrigerant at the outlet of the radiator is determined by a pressure of the $CO_2$ refrigerant discharged from the compressor and a temperature of the $CO_2$ refrigerant at the outlet of the radiator, and the temperature of the $CO_2$ refrigerant at the outlet of radiator is determined by radiating capacity of the radiator and a temperature of outside air. Because the temperature of the outside air is not controlled, the temperature of the $CO_2$ refrigerant at the outlet of the radiator cannot be controlled actually. Therefore, the state of the $CO_2$ refrigerant at the outlet of the radiator is controlled by controlling the pressure of the $CO_2$ refrigerant discharged from the compressor. Thus, to obtain a sufficient cooling capacity (i.e., enthalpy difference) in the summer, it is necessary to increase the pressure of the $CO_2$ refrigerant at the outlet of the radiator. That is, in the $CO_2$ refrigerant cycle, it is necessary to increase the compression performance of the compressor, as shown by E-F-G-H-E in FIG. 5.

On the other hand, the compressor is generally lubricated by using a lubricating oil mixed in refrigerant, and the lubricating oil having a high compatibility relative to the refrigerant is generally used to prevent the lubricating oil from staying in an evaporator and a radiator. Further, to supply a sufficient amount of lubricating oil to the compressor, an opening is provided at a liquid refrigerant layer in a gas-liquid separator, and the lubricating oil is introduced into the compressor with the liquid refrigerant. Thus, there are problems that coefficient of performance of the refrigerant cycle is deteriorated and a damage to the compressor is caused.

Further, as described above, in the conventional $CO_2$ refrigerant cycle, because the operation pressure is high and the amount of the $CO_2$ refrigerant discharged from the compressor is small, the above-described problems may be readily caused.

SUMMARY OF THE INVENTION

In view of the foregoing problems, it is an object of the present invention to prevent a damage to a compressor and deterioration of performance of a refrigerant cycle in which a pressure in a radiator exceeds a critical pressure of refrigerant.

According to the present invention, in a refrigerant cycle, a lubricating oil for a compressor has a compatibility relative to the refrigerant, and the compatibility of the lubricating oil relative to the refrigerant at a pressure lower than a predetermined pressure is lower than that at a pressure higher than the predetermined pressure. Further, a gas-liquid separator is disposed to separate the refrigerant and the lubricating oil from an evaporator into a gas refrigerant layer, a liquid refrigerant layer and a liquid lubricating oil layer. The gas-liquid separator has a first opening portion which is opened in the gas refrigerant layer and communicates with a suction port of the compressor, and a second opening portion which is opened in the liquid lubricating oil layer and communicates with the suction port of the compressor. Because the compatibility of the lubricating oil relative to the refrigerant at the pressure lower than a predetermined pressure is lower than that at the pressure higher than the predetermined pressure, the lubricating oil can be separated from the liquid refrigerant in the gas-liquid separator; and therefore, only the lubricating oil can be readily introduced into the compressor through the second opening portion without introducing the liquid refrigerant into the compressor. As a result, it can prevent a damage to the compressor while preventing deterioration of coefficient of performance of the refrigerant cycle.

On the other hand, because a pressure in the radiator is larger than a critical pressure of the refrigerant, the compatibility of the lubricating oil relative to the refrigerant becomes larger; and therefore, the lubricating oil flows with the refrigerant in the radiator. Thus, it can prevent the lubricating oil from staying in the radiator and heat-exchanging effect of the radiator from being lowered.

Preferably, the refrigerant is carbon dioxide, and the lubricating oil is polyalkylglycol oil or polyvinylether oil. Therefore, the above-described effect of the present invention can be readily proposed.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

Figure 1:
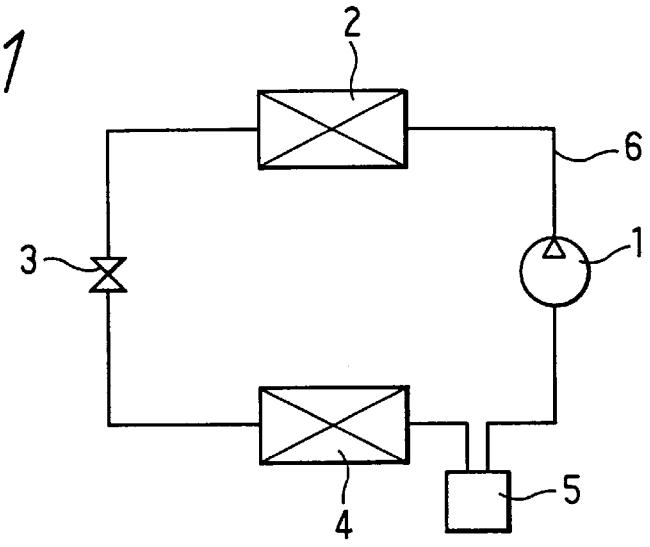
FIG. 1 is a diagrammatic view showing a $CO_2$ refrigerant cycle according to a preferred embodiment of the present invention.

A preferred embodiment of the present invention will be described hereinafter with reference to the accompanying drawings. In the embodiment, a $CO_2$ refrigerant cycle is applied to an air conditioning apparatus for a vehicle. The $CO_2$ refrigerant cycle includes a compressor 1 for compressing gas $CO_2$ refrigerant, a radiator 2 for cooling the compressed $CO_2$ refrigerant from the compressor 1 by performing heat exchange between the $CO_2$ refrigerant and outside air, a pressure control valve 3 which controls a pressure of the $CO_2$ refrigerant at an outlet side of the radiator 2 according to a temperature of the $CO_2$ refrigerant at the outlet side of the radiator 2, an evaporator 4 for cooling air passing therethrough, and an accumulator 5 (i.e., gas-liquid separator).

Figure 5:
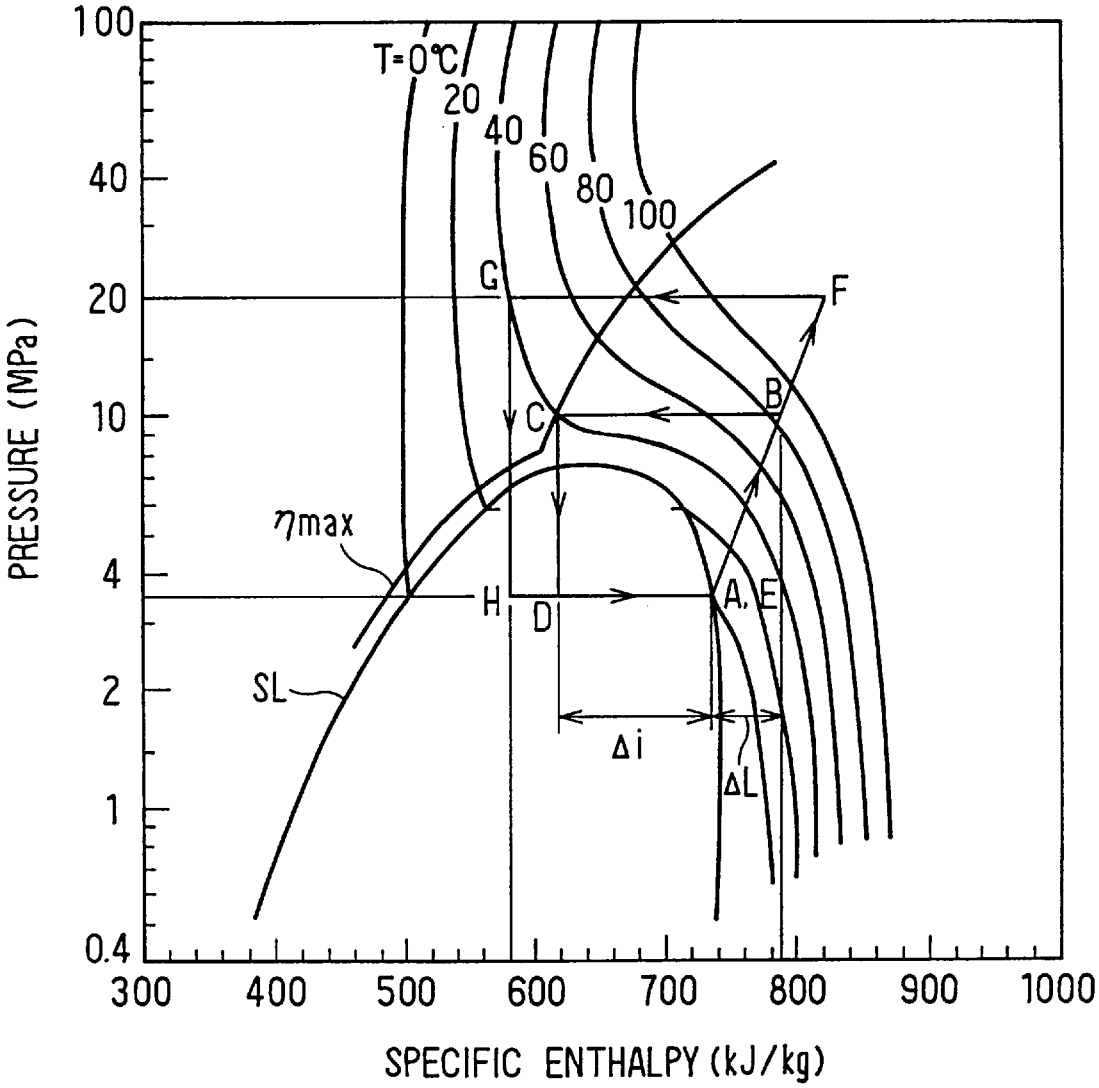
FIG. 5 is Mollier chart of carbon dioxide.

In the embodiment, the opening degree of the pressure control valve 3 is controlled in such a manner that the relationship between the temperature of the $CO_2$ refrigerant at the outlet side of the radiator 2 and the pressure of the $CO_2$ refrigerant at the outlet side of the radiator 2 becomes in the relationship shown by a solid line $\eta_{max}$ in FIG. 5. That is, the pressure control valve 3 controls the pressure of the $CO_2$ refrigerant at the outlet side of the radiator 2, and reduces the pressure of the $CO_2$ refrigerant flowing from the radiator 2. In the embodiment, the solid line $\eta_{max}$ in FIG. 5 is for controlling the pressure of the $CO_2$ refrigerant at the outlet side of the radiator 2 so that coefficient of performance of the $CO_2$ refrigerant cycle become maximum, relative to the temperature of the $CO_2$ refrigerant at the outlet side of the radiator 2.

The evaporator 4 is disposed in an air conditioning case of the air conditioning apparatus to cool air to be blown into a passenger compartment of the vehicle. When gas-liquid two-phase $CO_2$ refrigerant is evaporated in the evaporator 4, the $CO_2$ refrigerant absorbs heat from air in the air conditioning case to cool the air. The accumulator 5 temporarily stores liquid $CO_2$ refrigerant, and can separates gas-liquid two-phase $CO_2$ refrigerant from the evaporator 4 into liquid $CO_2$ refrigerant and gas $CO_2$ refrigerant.

The compressor 1, the radiator 2, the pressure control valve 3, the evaporator 4 and the accumulator 5 are respectively connected by a pipe 6 to form a closed circuit. The compressor 1 is driven by a driving force from a driving source such as an engine and a motor. The radiator 2 is disposed at a front side of a vehicle to increase a temperature difference between $CO_2$ refrigerant and outside air.

Next, a structure of the accumulator 5 will be now described with reference to FIG. 2. The accumulator 5 includes a tank portion 51 in which gas $CO_2$ refrigerant from the evaporator 4, an excess liquid $CO_2$ refrigerant and a lubricating oil for lubricating the compressor 1 are stored. An inlet 52 connected to the evaporator 4 is formed at an upper position of the tank portion 51. A U-shaped pipe 53 is disposed within the tank portion 51. A first opening portion 53*a* opened at a gas-phase area A (upper area) of the $CO_2$ refrigerant in the tank portion 51 is formed at one end side of the U-shaped pipe 53, and the other end side of the U-shaped pipe 53 is connected to a suction side of the compressor 1. A bent portion (i.e., bottom portion) of the U-shaped pipe 53 is positioned at a liquid-phase area C (i.e., lower area) of the lubricating oil within the tank portion 51, and a second opening portion 53*b* for only introducing the lubricating oil into the U-shaped pipe 53 is formed in the bent portion. Therefore, only the lubricating oil can be introduced from the second opening portion 53*b* into the compressor 1 through the U-shaped pipe 53. Within the tank portion 51, a liquid-phase area B (middle area) of the $CO_2$ refrigerant is formed between the gas-phase area A of the $CO_2$ refrigerant and the liquid-phase area C of the lubricating oil.

Further, in the embodiment, the lubricating oil is selected so that the liquid lubricating oil is separated with the liquid $CO_2$ refrigerant within the tank portion 51, and a density of the liquid lubricating oil is larger than that of the liquid $CO_2$ refrigerant. That is, in the embodiment, when a pressure is lower than a critical pressure Pc of the $CO_2$ refrigerant, a compatibility of the lubricating oil relative to the $CO_2$ refrigerant is lower than that in a case where the pressure is higher than the critical pressure Pc. For example, in the embodiment, the lubricating oil is polyalkylglycol (PGK) oil or polyvinylether (PVE) oil. The compatibility is a performance for uniformly mixing different kinds of polymers.

According to the embodiment of the present invention, the compatibility of the lubricating oil relative to the $CO_2$ refrigerant is lower at the pressure lower than the critical pressure Pc of the $CO_2$ refrigerant, as compared with the compatibility of the lubricating oil relative to the $CO_2$ refrigerant at the pressure higher than the critical pressure Pc of the $CO_2$ refrigerant. Further, the density of the liquid lubricating oil is larger than that of the liquid $CO_2$ refrigerant. Thus, at a low pressure side lower than the critical pressure Pc of the $CO_2$ refrigerant, such as the evaporator 4 and the accumulator 5, the liquid lubricating oil is gathered at a lower side of the liquid $CO_2$ refrigerant, so that the lubricating oil and the $CO_2$ refrigerant can be separated.

Figure 2:
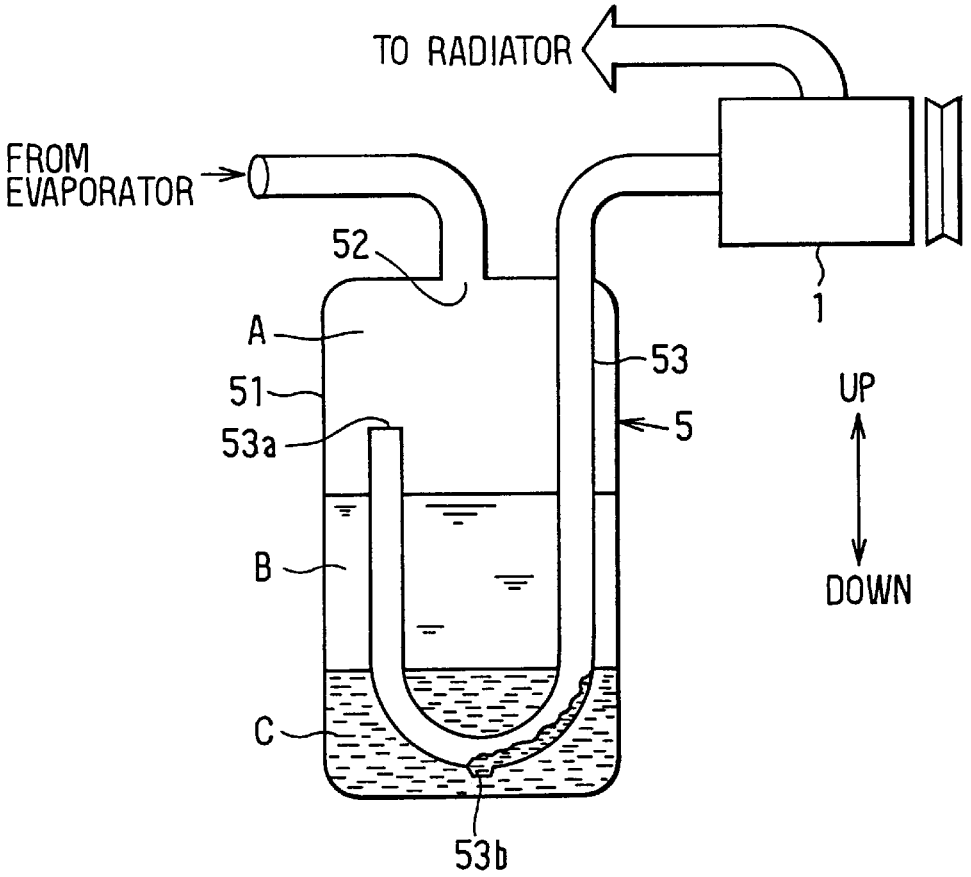
FIG. 2 is a diagrammatic view showing an accumulator of the $CO_2$ refrigerant cycle according to the embodiment.

As shown in FIG. 2, in the embodiment, because only the lubricating oil can be readily sucked and introduced into the compressor 1 through the second opening portion 53*b*, a damage to the compressor 1 can be prevented while the coefficient of performance of the $CO_2$ refrigerant cycle is improved. That is, through the second opening portion 53*b*, only the lubricating oil is introduced into the compressor 1 and the liquid $CO_2$ refrigerant is not sucked. Therefore, the $CO_2$ refrigerant cycle prevents the damage to the compressor 1 while preventing deterioration of the coefficient of performance.

On the other hand, the compatibility of the lubricating oil becomes higher in a super-critical pressure side where the pressure is higher than the critical pressure Pc, such as the radiator 2. Therefore, it can prevent the lubricating oil from staying in the radiator 2 to prevent heat-exchanging performance of the radiator 2 from being lowered. Thus, the performance of the $CO_2$ refrigerant cycle can be further improved.

As a result of studies and examinations by the inventors, when the lubricating oil is the polyalkylglycol (PGK) oil or the polyvinylether (PVE) oil, a lubricating oil used for a general flon refrigerant cycle can be circulated in the $CO_2$ refrigerant cycle.

Figure 3:
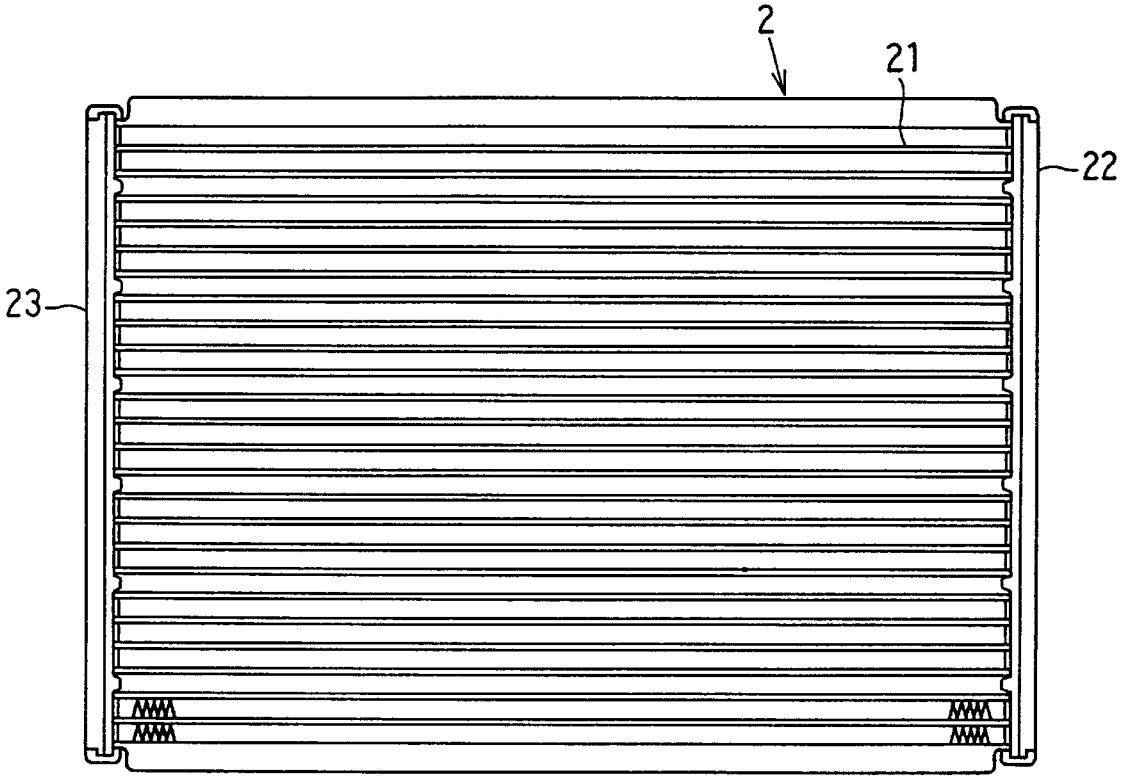
FIG. 3 is a front view showing a radiator of the $CO_2$ refrigerant cycle according to the embodiment.

In the embodiment, the radiator 2 is formed as shown in FIG. 3 to improve heat-exchanging effect in the radiator 2. That is, as shown in FIG. 3, the radiator 2 includes a plurality tubes 21 disposed in parallel with each other, a first tank 22 disposed at one end side of each tube 21, and a second tank 23 disposed at the other end side of each tube 21. In the radiator 2, $CO_2$ refrigerant is distributed into each tube 21 through the first tank 22, and the $CO_2$ refrigerant having heat-exchanged in the tubes 21 is discharged to the outside of the radiator 2 through the second tank 23. However, in this type radiator 2, a sectional area of refrigerant passage is greatly changed at connection portions between the first and second tanks 22, 23 and the tubes 21. Thus, in this type radiator 2, a flow rate of $CO_2$ refrigerant is lowered at the connection portions; and therefore, the lubricating oil having a larger density as compared with the $CO_2$ refrigerant readily stays in the radiator 2. However, according to the embodiment of the present invention, because the compatibility of the lubricating oil becomes higher in the radiator 2, it can prevent the lubricating oil from staying in the radiator 2.

In the above-described embodiment, the compatibility of the lubricating oil is changed according to the low pressure lower than the critical pressure Pc and the super-critical pressure higher than the critical pressure Pc. That is, the critical pressure Pc of the $CO_2$ refrigerant is used as a standard pressure, and a lubricating oil that is changed according to the critical pressure Pc is used in the embodiment. However, the standard pressure of the present invention is not limited to the critical pressure Pc, and can be suitably selected according to the pressure of the $CO_2$ refrigerant at a side of the radiator 2 and the pressure of the $CO_2$ refrigerant at a side of the evaporator 4 (accumulator 5). Thus, the lubricating oil is not limited to the polyalkylglycol (PGK) oil or the polyvinylether (PVE) oil.

Figure 4:
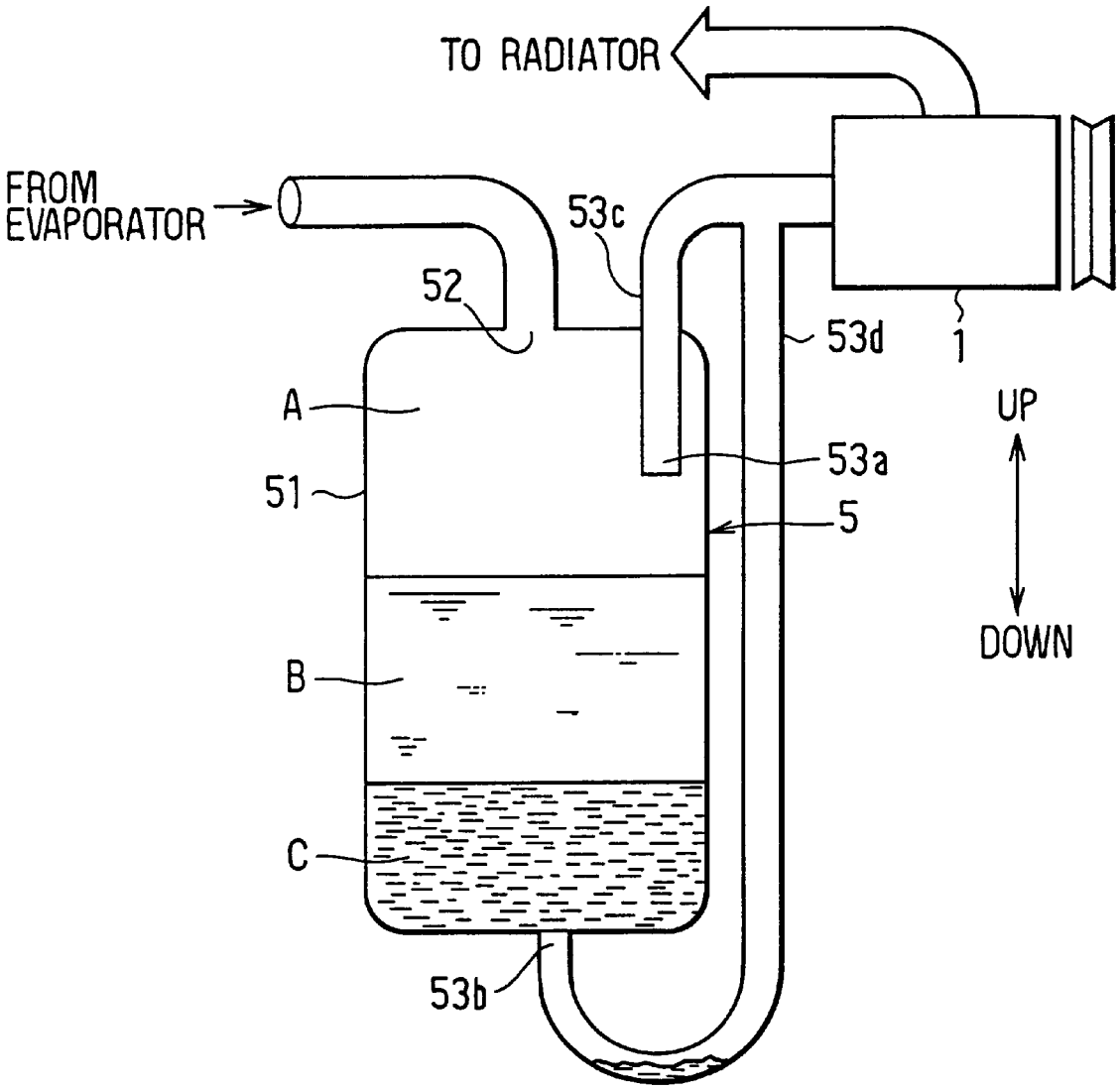
FIG. 4 is diagrammatic view showing an accumulator of the $CO_2$ refrigerant cycle according to a modification of the embodiment.

Further, the structure of the accumulator 5 is not limited to the structure shown in FIG. 2, and can be changed. As shown in FIG. 4, the U-shaped pipe 53 may be omitted in the tank portion 51. In this case, the first opening portion 53*a* is formed at one end of a pipe 53*c* connected to the compressor 1, and the second opening portion 53*b* is formed at one end of a pipe 53*d* connected to the compressor 1. That is, according to the present invention, the accumulator 5 has a structure in which the gas $CO_2$ refrigerant and the liquid lubricating oil are introduced into the compressor 1 and the liquid $CO_2$ refrigerant is not sucked into the compressor 1.

Further, in the above-described embodiment, the $CO_2$ refrigerant is used in the refrigerant cycle. However, the other refrigerant may be used in the refrigerant cycle. That is, the present invention may be applied to a refrigerant cycle in which a pressure within the radiator is larger than a critical pressure of the refrigerant.

Although the present invention has been fully described in connection with the preferred embodiment thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A refrigerant cycle comprising:

a radiator for cooling refrigerant flowing therethrough, said radiator having therein a pressure larger than a critical pressure of the refrigerant;

a compressor for compressing refrigerant and for discharging the refrigerant toward said radiator, said compressor sucking a lubricating oil with the refrigerant;

a pressure-reducing unit for reducing a pressure of the refrigerant from said radiator;

an evaporator for vaporizing the refrigerant from said pressure-reducing unit;

a gas-liquid separator, disposed between said evaporator and said compressor, for separating the refrigerant and the lubricating oil from said evaporator into a gas refrigerant layer, a liquid refrigerant layer and a liquid lubricating oil layer, wherein:

said gas-liquid separator has a first opening portion which is opened in the gas refrigerant layer and communicates with a suction port of said compressor, and a second opening portion which is opened in the liquid lubricating oil layer and communicates with said suction port of said compressor; and the lubricating oil has a compatibility relative to the refrigerant, the compatibility of the lubricating oil relative to the refrigerant at a pressure lower than a predetermined pressure is lower than that at a pressure higher than the predetermined pressure.

2. The refrigerant cycle according to claim 1, wherein:

the lubricating oil has a liquid density larger than a liquid density of the refrigerant; and said second opening portion is formed at a bottom of said gas-liquid separator.

3. The refrigerant cycle according to claim 1, wherein:

the refrigerant is carbon dioxide; and the lubricating oil is polyalkylglycol oil.

4. The refrigerant cycle according to claim 1, wherein:

the refrigerant is carbon dioxide; and the lubricating oil is polyvinylether oil.

5. The refrigerant cycle according to claim 1, wherein the predetermined pressure is the critical pressure of the refrigerant.

6. The refrigerant cycle according to claim 1, wherein:

said gas-liquid separator includes a tank for receiving the refrigerant and the lubricating oil therein; and the refrigerant and the lubricating oil is separated in said tank so that the liquid lubricating oil layer is at a lower side of said tank, the liquid refrigerant layer is at an upper side of the liquid lubricating oil layer, and the gas refrigerant layer is at an upper side of the liquid refrigerant layer.

7. The refrigerant cycle according to claim 6, wherein:

said gas-liquid separator has a communication pipe which communicates with said suction port of said compressor;

said first opening portion is formed at one end of said communication pipe to be opened at the gas refrigerant layer in said tank; and said second opening portion is formed in said communication pipe to be opened at the liquid lubricating oil layer in said tank.

8. The refrigerant cycle according to claim 7, wherein:

said communication pipe is a U-shaped pipe;

said first opening portion is formed at one end of said U-shaped pipe; and said second opening portion is formed at a bottom of said U-shaped pipe.

9. A lubricating oil for a compressor of a refrigerant cycle including a radiator for cooling refrigerant having a pressure higher than a critical pressure of the refrigerant, wherein:

the lubricating oil circulates in the refrigerant cycle with the refrigerant;

the lubricating oil has a compatibility relative to the refrigerant; and the compatibility of the lubricating oil relative to the refrigerant when the pressure of the refrigerant is lower than a predetermined pressure is lower than that when the pressure of the refrigerant is higher than the predetermined pressure.

10. A refrigerant cycle in which a lubricating oil circulates with refrigerant, said refrigerant cycle comprising:

a radiator for cooling refrigerant flowing therethrough, said radiator having therein a pressure larger than a critical pressure of the refrigerant;

a compressor for compressing refrigerant and for discharging the refrigerant toward said radiator, said compressor sucking the lubricating oil with the refrigerant;

a pressure-reducing unit for reducing the pressure of the refrigerant from said radiator to be lower than a predetermined pressure;

an evaporator for vaporizing the refrigerant from said pressure-reducing unit; and gas-liquid separator, disposed between said evaporator and said compressor, for separating the refrigerant and the lubricating oil from said evaporator into a gas refrigerant layer, a liquid refrigerant layer and a liquid lubricating oil layer, wherein:

the lubricating oil has a compatibility relative to the refrigerant, the compatibility of the lubricating oil relative to the refrigerant becomes smaller at a pressure lower than the predetermined pressure so that the refrigerant and the lubricating oil from said evaporator is separated in said gas-liquid separator into the gas refrigerant layer, the liquid refrigerant layer and the liquid lubricating oil layer; and said gas-liquid separator has a first opening portion which is opened in the gas refrigerant layer and communicates with a suction port of said compressor, and a second opening portion which is opened in the liquid lubricating oil layer and communicates with said suction port of said compressor.

11. The refrigerant cycle according to claim 10, wherein the compatibility of the lubricating oil relative to the refrigerant becomes larger at a pressure higher than the predetermined pressure so that the lubricating oil readily flows through said radiator with a flow of the refrigerant.

12. The refrigerant cycle according to claim 11, wherein the lubricating oil has a liquid density larger than a liquid density of the refrigerant.

* * * * *